US008504341B2

(12) United States Patent
Cullick et al.

(10) Patent No.: US 8,504,341 B2
(45) Date of Patent: Aug. 6, 2013

(54) METHODS, SYSTEMS, AND COMPUTER READABLE MEDIA FOR FAST UPDATING OF OIL AND GAS FIELD PRODUCTION MODELS WITH PHYSICAL AND PROXY SIMULATORS

(75) Inventors: Alvin Stanley Cullick, Houston, TX (US); William Douglas Johnson, Austin, TX (US)

(73) Assignee: Landmark Graphics Corporation, Houston, TX (US)

( * ) Notice: Subject to any disclaimer, the term of this patent is extended or adjusted under 35 U.S.C. 154(b) by 475 days.

(21) Appl. No.: 11/669,928

(22) Filed: Jan. 31, 2007

(65) Prior Publication Data

US 2007/0179768 A1 Aug. 2, 2007

Related U.S. Application Data

(60) Provisional application No. 60/763,973, filed on Jan. 31, 2006.

(51) Int. Cl.

| | |
|---|---|
| ***G06G 7/48*** | (2006.01) |
| ***G06F 17/10*** | (2006.01) |
| ***G06F 15/18*** | (2006.01) |
| ***G01N 15/08*** | (2006.01) |

(52) U.S. Cl.
USPC ..... 703/10; 703/9; 703/2; 702/12; 702/13; 706/6; 706/44; 706/929

(58) Field of Classification Search ..... 703/10; 706/929
See application file for complete search history.

(56) References Cited

U.S. PATENT DOCUMENTS

| | | | |
|---|---|---|---|
| 4,665,398 | A | 5/1987 | Lynch et al. |
| 5,062,068 | A | 10/1991 | Kondo et al. |
| 5,148,365 | A | 9/1992 | Dembo |
| 5,182,730 | A | 1/1993 | Scherbatskoy |
| 5,315,530 | A | 5/1994 | Gerhardt et al. |
| 5,455,780 | A | 10/1995 | Nguyen et al. |
| 5,835,883 | A | 11/1998 | Neff et al. |

(Continued)

FOREIGN PATENT DOCUMENTS

EP 1 982 046 B1 3/2011

OTHER PUBLICATIONS

XP-002438774, SPE 94357, "Treating Uncertainties in Reservoir Performance Prediction with Neural Networks", J.P. Lechner, G. Zangl, Copyright 2005, Society of Petroleum Engineers Inc., 8 pages.*

(Continued)

*Primary Examiner* — Akash Saxena
(74) *Attorney, Agent, or Firm* — Merchant & Gould

(57) ABSTRACT

Methods, systems, and computer readable media are provided for fast updating of oil and gas field production optimization using physical and proxy simulators. A base model of a reservoir, well, or a pipeline network is established in one or more physical simulators. A decision management system is used to define uncertain parameters for matching with observed data. A proxy model is used to fit the uncertain parameters to outputs of the physical simulators, determine sensitivities of the uncertain parameters, and compute correlations between the uncertain parameters and output data from the physical simulators. Parameters for which the sensitivities are below a threshold are eliminated. The decision management system validates parameters which are output from the proxy model in the simulators. The validated parameters are used to make production decisions.

19 Claims, 3 Drawing Sheets

U.S. PATENT DOCUMENTS

| | | | | |
|---|---|---|---|---|
| 5,841,678 | A | 11/1998 | Hasenberg et al. | |
| 5,924,048 | A | 7/1999 | McCormack et al. | |
| 5,992,519 | A | 11/1999 | Ramakrishnan et al. | |
| 6,002,985 | A * | 12/1999 | Stephenson | 702/13 |
| 6,088,656 | A | 7/2000 | Ramakrishnan et al. | |
| 6,101,447 | A * | 8/2000 | Poe, Jr. | 702/13 |
| 6,128,579 | A | 10/2000 | McCormack et al. | |
| 6,229,308 | B1 * | 5/2001 | Freedman | 324/303 |
| 6,442,445 | B1 | 8/2002 | Bunkofske et al. | |
| 6,584,368 | B2 | 6/2003 | Bunkofske et al. | |
| 6,595,294 | B1 | 7/2003 | Dalsmo et al. | |
| 6,618,695 | B1 * | 9/2003 | Hu et al. | 703/2 |
| 6,678,569 | B2 | 1/2004 | Bunkofske et al. | |
| 6,704,696 | B1 | 3/2004 | Kuramochi et al. | |
| 6,823,296 | B2 | 11/2004 | Rey-Fabret et al. | |
| 6,853,921 | B2 | 2/2005 | Thomas et al. | |
| 6,980,940 | B1 | 12/2005 | Gurpinar et al. | |
| 7,027,968 | B2 | 4/2006 | Choe et al. | |
| 7,054,752 | B2 | 5/2006 | Zabalza-Mezghani et al. | |
| 7,266,456 | B2 | 9/2007 | De Guzman et al. | |
| 7,292,250 | B2 * | 11/2007 | Sepulveda | 345/473 |
| 7,415,328 | B2 | 8/2008 | Volponi | |
| 7,512,543 | B2 | 3/2009 | Raghuraman et al. | |
| 7,526,463 | B2 * | 4/2009 | Collette et al. | 706/23 |
| 7,610,251 | B2 * | 10/2009 | Shayegi et al. | 706/21 |
| 7,636,613 | B2 | 12/2009 | Borah et al. | |
| 7,668,707 | B2 | 2/2010 | Watts et al. | |
| 7,702,409 | B2 | 4/2010 | Lucas et al. | |
| 7,953,585 | B2 * | 5/2011 | Gurpinar et al. | 703/10 |
| 8,025,072 | B2 | 9/2011 | Atkinson et al. | |
| 8,041,650 | B2 * | 10/2011 | Gaffey et al. | 705/342 |
| 2002/0013687 | A1 * | 1/2002 | Ortoleva | 703/10 |
| 2002/0049575 | A1 | 4/2002 | Jalali et al. | |
| 2002/0120429 | A1 * | 8/2002 | Ortoleva | 703/2 |
| 2002/0177955 | A1 | 11/2002 | Jalali et al. | |
| 2003/0010208 | A1 | 1/2003 | Jagger et al. | |
| 2003/0139916 | A1 | 7/2003 | Chloe et al. | |
| 2003/0220750 | A1 * | 11/2003 | Delhomme et al. | 702/50 |
| 2004/0064425 | A1 * | 4/2004 | Depold et al. | 706/25 |
| 2004/0104027 | A1 * | 6/2004 | Rossi et al. | 166/250.15 |
| 2004/0144565 | A1 | 7/2004 | Koederitz | |
| 2004/0220790 | A1 | 11/2004 | Cullick et al. | |
| 2004/0254734 | A1 | 12/2004 | Zabalza-Mezghani et al. | |
| 2005/0010383 | A1 * | 1/2005 | Le Ravalec-Dupin et al. | 703/10 |
| 2005/0096893 | A1 | 5/2005 | Feraille et al. | |
| 2005/0119911 | A1 * | 6/2005 | Ayan et al. | 705/1 |
| 2006/0044307 | A1 * | 3/2006 | Song | 345/419 |
| 2006/0184477 | A1 | 8/2006 | Hartman et al. | |
| 2006/0224369 | A1 | 10/2006 | Yang et al. | |
| 2007/0150079 | A1 | 6/2007 | Blevins et al. | |
| 2007/0156377 | A1 | 7/2007 | Gurpinar et al. | |
| 2007/0168056 | A1 | 7/2007 | Shayegi et al. | |
| 2007/0168057 | A1 * | 7/2007 | Blevins et al. | 700/53 |
| 2007/0179766 | A1 | 8/2007 | Cullick et al. | |
| 2007/0179767 | A1 | 8/2007 | Cullick et al. | |
| 2007/0192072 | A1 | 8/2007 | Cullick | |
| 2008/0133194 | A1 | 6/2008 | Klumpen et al. | |
| 2008/0262737 | A1 | 10/2008 | Thigpen et al. | |
| 2008/0288172 | A1 * | 11/2008 | Stone | 702/13 |
| 2009/0192632 | A1 | 7/2009 | Yamartino | |
| 2010/0078047 | A1 | 4/2010 | Labib et al. | |
| 2010/0131257 | A1 | 5/2010 | Watts et al. | |
| 2011/0010079 | A1 | 1/2011 | Shutty et al. | |

OTHER PUBLICATIONS

XP-002438797, SPE 93569, "Determination of WAG Ratios and Slug Sizes Under Certainty in a Smart Wells Environment", T.E.H. Esmaiel, S. Fallah, C.P.J.W. van Kruijsdijk, Copyright 2005, Society of Petroleum Engineers, 9 pages.*

"TERAS Evaluation Module User Guide", Landmark Graphics Corporation, 2000, Part No. 157607, R98.7, 215 pages.*

"Development of a Probabilistic Forecasting and History Matching Model of the Coalbed Methane Reservoirs" presented in 2005 International Coalbed Methane Symposium by Anne Y. Oudinot et al.; 2005, pp. 1-12.*

A Methodology for History Matching and the Assessment of Uncertainties Associated with Flow Prediction ; Landa et al SPE 2003 pp. 1-14.*

Improved and More-Rapid History Matching With a Nonlinear Proxy and Global Optimization A.S. Cullick, Sep. 24-27, 2006 pp. 1-13.*

Real Time Optimization: Classification and Assessment: Author S. Mochizuki, ExxonMobil; L.A. Saputelli, Halliburton; C.S. Kabir, ChevronTexaco; R. Cramer, Shell; M.J. Lochmann, Topsail Ventures; R.D. Reese, Case Services; L.K. Harms, ConocoPhillips; C.D. Sisk, BP; J.R. Hite, Business Fundamentals Group; A. Escorcia, Halliburton; 2004; pp. 1-4.*

Real-Time Production Optimization of Oil and Gas Production Systems: A Technology Survey; H.P. Bieker, SPE, NTNU; O. Slupphaug, SPE, ABB; T.A. Johansen, NTNU; 2007; pp. 382-391.*

Yeten, et al, "A comparison study on experimental design and response surface methodologies", Proceedings 2005 SPE Reservoir Simulation Symposium, 2005, pp. 1-15, Society of Petroleum Engineers Inc.

Sung, Andrew H., "Applications of soft computing in petroleum engineering", Proceedings of SPIE—The International Society for Optical Engineering, v 3812, pp. 200-212, Jul. 1999.

Sengul, et al., "Applied production Optimization: i-Field", Proceedings—SPE Annual Technical Conference and Exhibition, pp. 2349-2360, 2002, Society of Petroleum Engineers Inc.

Oberwinkler, et al., From real time data to production optimization, Proceedings of the SPE Asia Pacific Conference on Integrated Modelling for Asset Management, pp. 1-14, Mar. 2004.

XP-002358198, SPE 56696, "Managing Uncertainties on Production Predictions Using Integrated Statistical Methods", J.P. Dejean, G. Blanc, Copyright 1999, Society of Petroleum Engineers, Inc, 15 pages.

XP-002444470, IPTC 10751, "History Match and Associated Forecast Uncertainty Analysis-Practical Approaches Using Cluster Computer", J.L. Landa, R.K. Kalia, A. Nakano, K. Normura, P. Vashista, U. of Southern California, Copyright 2005, International Petroleum Technology Conference; 10 pages.

XP-002444471, SPE 93445, "Calculating Derivatives for History Matching in Reservoir Simulators", J.R.P., Rodriguez, PETROBAS, Copyright 2005, Society of Petroleum Engineers Inc., 9 pages.

XP-002438840, SPE 84465, "A Methodology for History Matching and the Assessment of Uncertainties Associated with Flow Prediction", Jorge L. Landa, Baris Guyaguler, Copyright 2003, Society of Petroleum Engineers, Inc., 14 pages.

XP-002438798, SPE 93568, "Reservoir Screening and Sensitivity Analysis of Water flooding With Smart Wells Through the Application of Experimental Design", T.E.H. Esmaiel S. Fallah, C.P.J.W. van Kruijsdijk, Copyright 2005, Society of Petroleum Engineers, 8 pages.

Mohaghegh, Shahab D., "Recent developments in application of artificial intelligence in Petroleum engineering", JPT, Journal of Petroleum Technology, v57, n4, Apr. 2005, pp. 86-91, 2005.

"A Critical Overview of Artificial Neural Network Applications in the Context of Continuous Oil Field Optimization", by L. Saputelli, University of Houston; PDVSA; H. Malki, University of Houston; J.Canelon, University of Houston; Universidad del Zulia; M. Nikolaou, University of Houston, Sep. 29, 2002 (SPE: 77703).

"Promoting Real-Time Optimization of Hydrocarbon Producing Systems", by L.A. Saputelli, U. of Houston et al.; Off shore Europe, Sep. 2-5, 2003, Aberdeen, United Kingdom (SPE: 83978).

"Optimizing Multiple-Field Scheduling and Production Strategy with Reduced Risk", Cullick et al. SPE 84239, SPE 2003.

"Conditioning Reservoir Models to Dynamic Data—A Forward Modeling Perspective", Srinivasan, SPE 62941, SPE 2000.

"Optimization of Smart Well Control", Yeten et al., SPE Petroleum Society of CIM/CHOA 79031, 2002.

Eclipse FloGrid, Blrt et al. Schlumberger Information Solution, Jul. 2003.

Improved and More-Rapid History Matching with a Nolinear Proxy and Global Optimization, Cullick et al., SPE 101933, 2006.

"Risk management for petroleum reservoir production: A Simulation-based study of prediction", Glimm et al., Computational Geosciences 5: 173-197, 2001.

"Proxy Simulations for Efficient Dynamics", Chenney et al., EUROGRAPHICS 2001.

"Model, Methods and middleware for grid-enabled multiphysics oil reservoir management", Klie et al, Engineering with Computer 22:349-370, 2006.
PCT International Search Report mailed Aug. 7, 2007, International Patent Application No. PCT/US2007/002619, Applicant Landmark Graphics Corporation, 15 pages.
PCT International Search Report mailed Jul. 4, 2007, International Patent Application No. PCT/US2007/002624, Applicant Landmark Graphics Corporation, 11 pages.
EP Communication mailed Jan. 15, 2009, in EP Application No. 07-762-832-9-2315, pp. 1-3.
EP Office Action mailed Apr. 2, 2010 in EP Application No. 07-762-8329-2315, pp. 1-3.
U.S. Office Action mailed Feb. 16, 2010, in U.S. Appl. No. 11/669,921, pp. 1-26.
U.S. Office Action mailed Jul. 22, 2009, in U.S. Appl. No. 11/669,921, pp. 1-23.
U.S. Office Action mailed Oct. 30, 2007, in U.S. Appl. No. 11/669,903, pp. 1-16.
U.S. Office Action mailed Jan. 11, 2008, in U.S. Appl. No. 11/669,903, pp. 1-25.
U.S. Office Action mailed Jan. 16, 2008, in U.S. Appl. No. 11/669,903, pp. 1-4.
U.S. Office Action mailed Jul. 17, 2008, in U.S. Appl. No. 11/669,903, pp. 1-28.
U.S. Office Action mailed Feb. 17, 2009, in U.S. Appl. No. 11/669,903, pp. 1-34.
U.S. Office Action mailed May 8, 2009, in U.S. Appl. No. 11/669,903, pp. 1-31.
U.S. Office Action mailed Apr. 29, 2009, in U.S. Appl. No. 11/669,911, pp. 1-30.
U.S. Office Action mailed Jul. 17, 2008, in U.S. Appl. No. 11/669,911, pp. 1-29.
U.S. Office Action mailed Jan. 11, 2008, in U.S. Appl. No. 11/669,911, pp. 1-26.
U.S. Office Action mailed Oct. 30, 2007, in U.S. Appl. No. 11/669,911, pp. 1-21.
U.S. Office Action mailed Feb. 17, 2009, in U.S. Appl. No. 11/669,911, pp. 1-33.
U.S. Office Action mailed Oct. 6, 2010 in U.S. Appl. No. 11/669,921, pp. 1-25.
Chinese First Office Action dated Sep. 13, 2010 in Application No. 200780004115.6, pp. 1-7.
U.S. Office Action dated May 24, 2011 in U.S. Appl. No. 11/669,921.
Real Time Optimization: Classification and Assessment: Author S. Mochizuki, ExxonMobil; L.A. Saputelli Halliburton; C.S. Kabir, ChevronTexaco; R. Cramer, Shell; M.J. Lochmann, Topsail Ventures; R.D. Reese, Case Services; L.K. Harms, ConocoPhillips; C.D. Sisk, BP; J.R. Hite, Business Fundamentals Group; A. Escorcia, Halliburton; 2004; pp. 1-4.

* cited by examiner

METHODS, SYSTEMS, AND COMPUTER READABLE MEDIA FOR FAST UPDATING OF OIL AND GAS FIELD PRODUCTION MODELS WITH PHYSICAL AND PROXY SIMULATORS

CROSS-REFERENCE TO RELATED APPLICATIONS

This patent application claims the benefit of U.S. Provisional Patent Application No. 60/763,973 entitled "Methods, systems, and computer-readable media for fast updating of oil and gas field production models with physical and proxy simulators," filed on Jan. 31, 2006 and expressly incorporated herein by reference.

TECHNICAL FIELD

The present invention is related to the optimization of oil and gas field production. More particularly, the present invention is related to the use of physical and proxy simulators for improving production decisions related to oil and gas fields.

BACKGROUND

Reservoir and production engineers tasked with modeling or managing large oil fields containing hundreds of wells are faced with the reality of only being able to physically evaluate and manage a few individual wells per day. Individual well management may include performing tests to measure the rate of oil, gas, and water coming out of an individual well (from below the surface) over a test period. Other tests may include tests for measuring the pressure above and below the surface as well as the flow of fluid at the surface. As a result of the time needed to manage individual wells in an oil field, production in large oil fields is managed by periodically (e.g., every few months) measuring fluids at collection points tied to multiple wells in an oil field and then allocating the measurements from the collection points back to the individual wells. Data collected from the periodic measurements is analyzed and used to make production decisions including optimizing future production. The collected data, however, may be several months old when it is analyzed and thus is not useful in real time management decisions. In addition to the aforementioned time constraints, multiple analysis tools may be utilized which making it difficult to construct a consistent analysis of a large field. These tools may be multiple physics-based simulators or analytical equations representing oil, gas, and water flow and processing.

In order to improve efficiency in oil field management, sensors have been installed in oil fields in recent years for continuously monitoring temperatures, fluid rates, and pressures. As a result, production engineers have much more data to analyze than was generated from previous periodic measurement methods. However, the increased data makes it difficult for production engineers to react to the data in time to respond to detected issues and make real time production decisions. For example, current methods enable the real time detection of excess water in the fluids produced by a well but do not enable an engineer to quickly respond to this data in order to change valve settings to reduce the amount of water upon detection of the excess water. Further developments in recent years have resulted in the use of computer models for optimizing oil field management and production. In particular, software models have been developed for reservoirs, wells, and gathering system performance in order to manage and optimize production. Typical models used include reservoir simulation, well nodal analysis, and network simulation physics-based or physical models. Currently, the use of physics-based models in managing production is problematic due to the length of time the models take to execute. Moreover, physics-based models must be "tuned" to field-measured production data (pressures, flow rates, temperatures, etc,) for optimizing production. Tuning is accomplished through a process of "history matching," which is complex, time consuming, and often does not result in producing unique models. For example, the history matching process may take many months for a specialist reservoir or production engineer. Furthermore, current history match algorithms and workflows for assisted or automated history matching are complex and cumbersome. In particular, in order to account for the many possible parameters in a reservoir system that could effect production predictions, many runs of one or more physics-based simulators would need to be executed, which is not practical in the industry.

It is with respect to these and other considerations that the present invention has been made.

SUMMARY

Illustrative embodiments of the present invention address these issues and others by providing for fast updating of oil and gas field production models using physical and proxy simulators. One illustrative embodiment includes a method for establishing a base model of a physical system in one or more physics-based simulators. The physical system may include a reservoir, a well, a pipeline network, and a processing system. The one or more simulators simulate the flow of fluids in the reservoir, well, pipeline network, and processing system. The method further includes using a decision management system to define uncertain parameters of the physical system for matching with observed data. The uncertain parameters may include permeability, fault transmissibility, pore volume, and well skin parameters. The method further includes defining a boundary limits and an uncertainty distribution for each of the uncertain parameters of the physical system through an experimental design process, automatically executing the one or more simulators over a set of design parameters to generate a series of outputs, the set of design parameters comprising the uncertain parameters and the outputs representing production predictions, collecting characterization data in a relational database, the characterization data comprising values associated with the set of design parameters and values associated with the outputs from the one or more simulators, fitting relational data comprising a series of inputs, the inputs comprising the values associated with the set of design parameters, to the outputs of the one or more simulators using a proxy model or equation system for the physical system. The proxy model may be a neural network and is used to calculate derivatives with respect to design parameters to determine sensitivities and compute correlations between the design parameters and the outputs of the one or more simulators. The method further includes eliminating the design parameters from the proxy model for which the sensitivities are below a threshold, using an optimizer with the proxy model to determine design parameter value ranges, for the design parameters which were not eliminated from the proxy model, for which outputs from the proxy model match observed data, the design parameters which were not eliminated then being designated as selected parameters, placing the selected parameters and their ranges from the proxy model into the decision management system, running the decision management system as a global optimizer to validate the selected parameters in the one or more simulators, and using the validated selected parameters from the one or more simulators for production decisions.

Other illustrative embodiments of the invention may also be implemented in a computer system or as an article of manufacture such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process.

These and various other features, as well as advantages, which characterize the present invention, will be apparent from a reading of the following detailed description and a review of the associated drawings.

DETAILED DESCRIPTION

Figure 1:
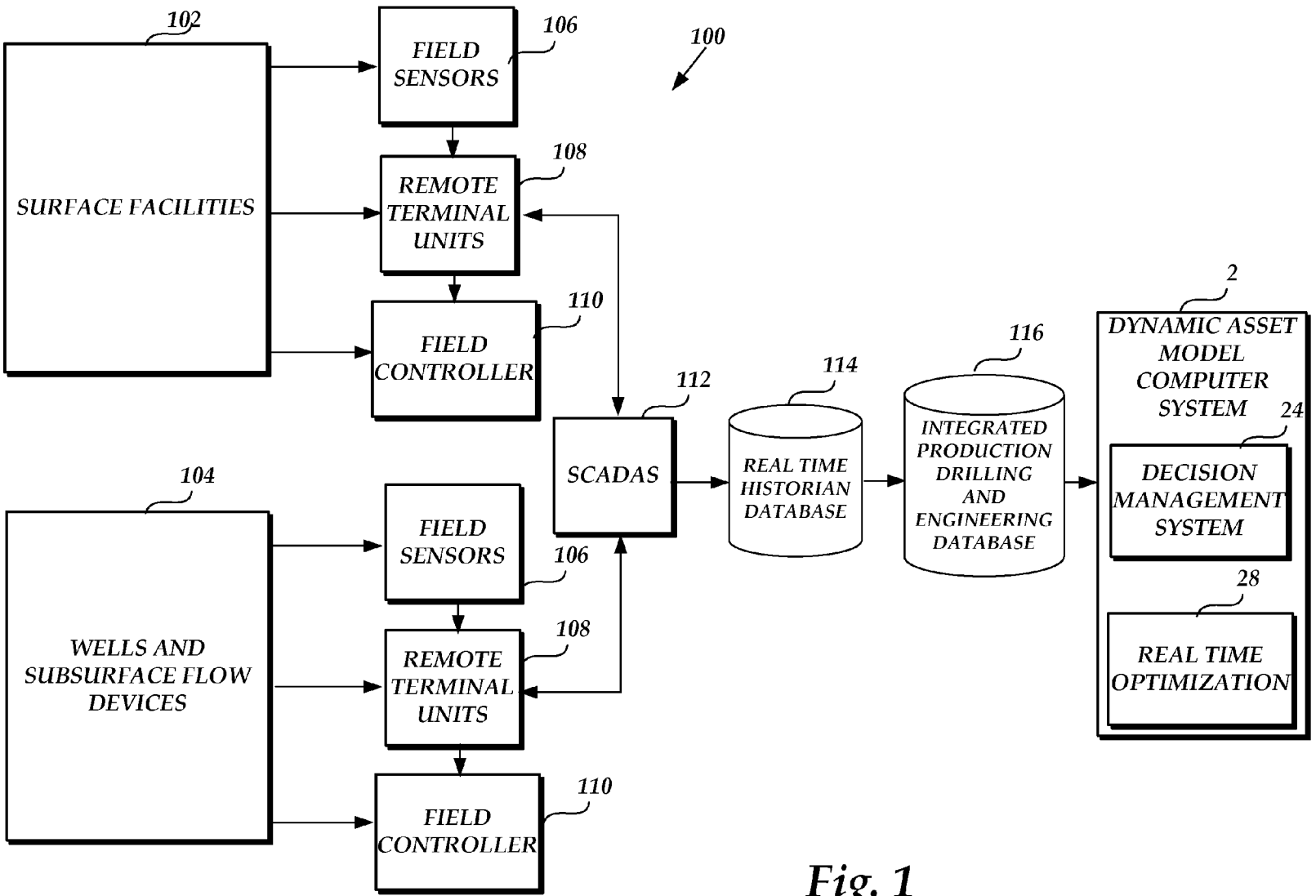
FIG. 1 is a simplified block diagram of an operating environment which may be utilized in accordance with the illustrative embodiments of the present invention.

Illustrative embodiments of the present invention provide for fast updating of oil and gas field production models using physical and proxy simulators. Referring now to the drawings, in which like numerals represent like elements, various aspects of the present invention will be described. In particular, FIG. 1 and the corresponding discussion are intended to provide a brief, general description of a suitable operating environment in which embodiments of the invention may be implemented.

Embodiments of the present invention may be generally employed in the operating environment 100 as shown in FIG. 1. The operating environment 100 includes oilfield surface facilities 102 and wells and subsurface flow devices 104. The oilfield surface facilities 102 may include any of a number of facilities typically used in oil and gas field production. These facilities may include, without limitation, drilling rigs, blow out preventers, mud pumps, and the like. The wells and subsurface flow devices may include, without limitation, reservoirs, wells, and pipeline networks (and their associated hardware). It should be understood that as discussed in the following description and in the appended claims, production may include oil and gas field drilling and exploration.

The surface facilities 102 and the wells and subsurface flow devices 104 are in communication with field sensors 106, remote terminal units 108, and field controllers 110, in a manner know to those skilled in the art. The field sensors 106 measure various surface and sub-surface properties of an oilfield (i.e., reservoirs, wells, and pipeline networks) including, but not limited to, oil, gas, and water production rates, water injection, tubing head, and node pressures, valve settings at field, zone, and well levels. In one embodiment of the invention, the field sensors 106 are capable of taking continuous measurements in an oilfield and communicating data in real-time to the remote terminal units 108. It should be appreciated by those skilled in the art that the operating environment 100 may include "smart fields" technology which enables the measurement of data at the surface as well as below the surface in the wells themselves. Smart fields also enable the measurement of individual zones and reservoirs in an oil field. The field controllers 110 receive the data measured from the field sensors 106 and enable field monitoring of the measured data.

The remote terminal units 108 receive measurement data from the field sensors 106 and communicate the measurement data to one or more Supervisory Control and Data Acquisition systems ("SCADAs") 112. As is known to those skilled in the art, SCADAs are computer systems for gathering and analyzing real time data. The SCADAs 112 communicate received measurement data to a real-time historian database 114. The real-time historian database 114 is in communication with an integrated production drilling and engineering database 116 which is capable of accessing the measurement data.

The integrated production drilling and engineering database 116 is in communication with a dynamic asset model computer system 2. In the various illustrative embodiments of the invention, the computer system 2 executes various program modules for fast updating of oil and gas field production models using physical and proxy simulators. Generally, program modules include routines, programs, components, data structures, and other types of structures that perform particular tasks or implement particular abstract data types. The program modules include a decision management system ("DMS") application 24 and a real-time optimization program module 28. The computer system 2 also includes additional program modules which will be described below in the description of FIG. 2. It will be appreciated that the communications between the field sensors 106, the remote terminal units 108, the field controllers 110, the SCADAs 112, the databases 114 and 116, and the computer system 2 may be enabled using communication links over a local area or wide area network in a manner known to those skilled in the art.

As will be discussed in greater detail below with respect to FIGS. 2-3, the computer system 2 uses the DMS application 24 in conjunction with a physical or physics-based simulators and a proxy model (as a proxy simulator) for fast updating of oil and gas field production models used in an oil or gas field. The core functionality of the DMS application 24 is described in detail in co-pending U.S. Published Patent Application 2004/0220790, entitled "Method and System for Scenario and Case Decision Management," which is incorporated herein by reference. The real-time optimization program module 28 uses the aforementioned proxy model to determine parameter value ranges for outputs which match real-time observed data measured by the field sensors 106.

Figure 2:
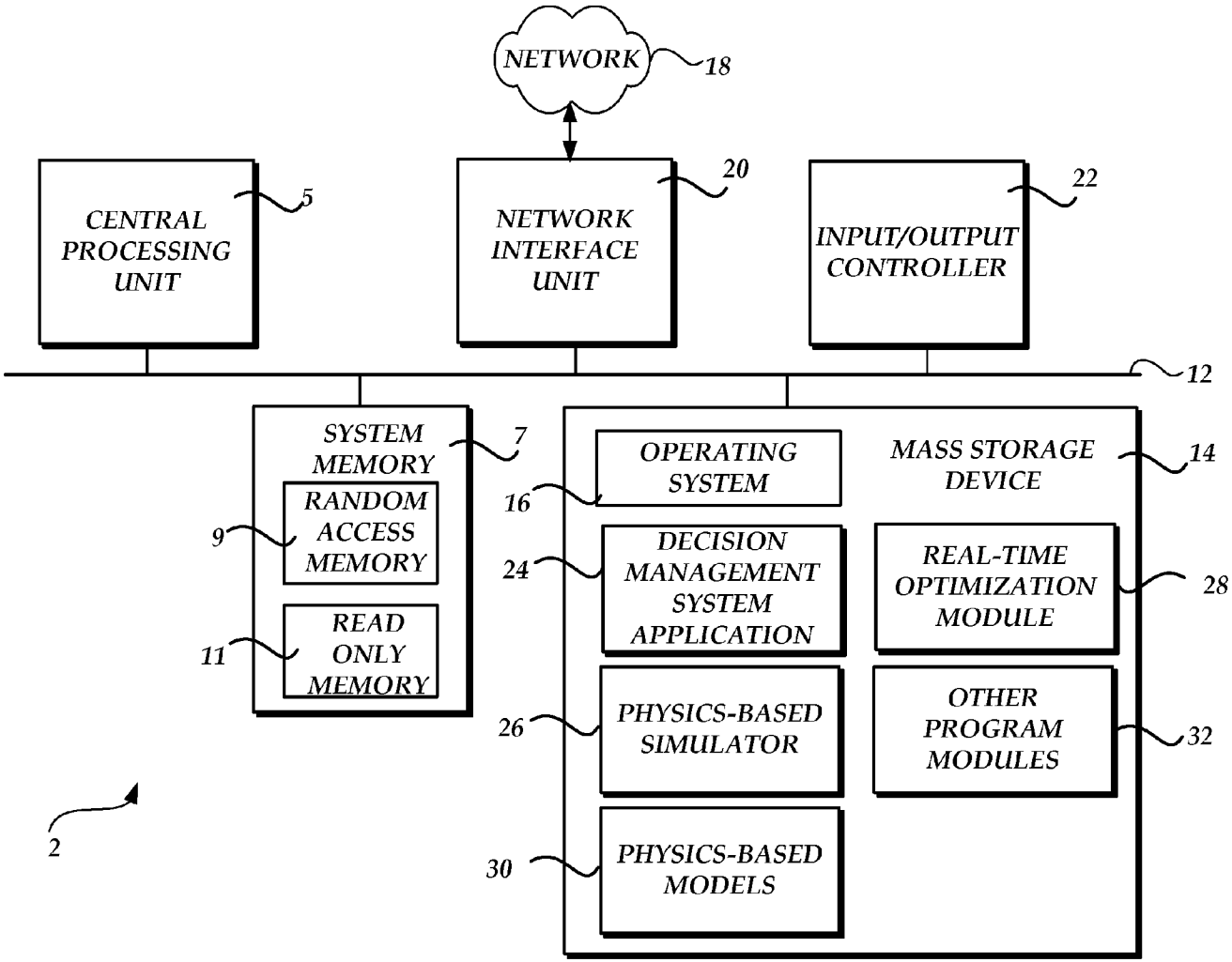
FIG. 2 is a simplified block diagram illustrating a computer system in the operating environment of FIG. 1, which may be utilized for performing various illustrative embodiments of the present invention.

Referring now to FIG. 2, an illustrative computer architecture for the computer system 2 which is utilized in the various embodiments of the invention, will be described. The computer architecture shown in FIG. 2 illustrates a conventional desktop or laptop computer, including a central processing unit 5 ("CPU"), a system memory 7, including a random access memory 9 ("RAM") and a read-only memory ("ROM") 11, and a system bus 12 that couples the memory to the CPU 5. A basic input/output system containing the basic routines that help to transfer information between elements within the computer, such as during startup, is stored in the ROM 11. The computer system 2 further includes a mass storage device 14 for storing an operating system 16, DMS application 24, a physics-based simulator 26, real-time optimization module 28, physics-based models 30, and other program modules 32. These modules will be described in greater detail below.

It should be understood that the computer system 2 for practicing embodiments of the invention may also be representative of other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

The mass storage device 14 is connected to the CPU 5 through a mass storage controller (not shown) connected to the bus 12. The mass storage device 14 and its associated computer-readable media provide non-volatile storage for the computer system 2. Although the description of computer-readable media contained herein refers to a mass storage device, such as a hard disk or CD-ROM drive, it should be appreciated by those skilled in the art that computer-readable media can be any available media that can be accessed by the computer system 2.

By way of example, and not limitation, computer-readable media may comprise computer storage media and communication media. Computer storage media includes volatile and non-volatile, removable and non-removable media implemented in any method or technology for storage of information such as computer-readable instructions, data structures, program modules or other data. Computer storage media includes, but is not limited to, RAM, ROM, EPROM, EEPROM, flash memory or other solid state memory technology, CD-ROM, digital versatile disks ("DVD"), or other optical storage, magnetic cassettes, magnetic tape, magnetic disk storage or other magnetic storage devices, or any other medium which can be used to store the desired information and which can be accessed by the computer system 2.

According to various embodiments of the invention, the computer system 2 may operate in a networked environment using logical connections to remote computers, databases, and other devices through the network 18. The computer system 2 may connect to the network 18 through a network interface unit 20 connected to the bus 12. Connections which may be made by the network interface unit 20 may include local area network ("LAN") or wide area network ("WAN") connections. LAN and WAN networking environments are commonplace in offices, enterprise-wide computer networks, intranets, and the Internet. It should be appreciated that the network interface unit 20 may also be utilized to connect to other types of networks and remote computer systems. The computer system 2 may also include an input/output controller 22 for receiving and processing input from a number of other devices, including a keyboard, mouse, or electronic stylus (not shown in FIG. 2). Similarly, an input/output controller 22 may provide output to a display screen, a printer, or other type of output device.

As mentioned briefly above, a number of program modules may be stored in the mass storage device 14 of the computer system 2, including an operating system 16 suitable for controlling the operation of a networked personal computer. The mass storage device 14 and RAM 9 may also store one or more program modules. In one embodiment, the DMS application 24 is utilized in conjunction with one or more physics-based simulators 26, real-time optimization module 28, and the physics-based models 30 to optimize production control parameters for real-time use in an oil or gas field. As is known to those skilled in the art, physics-based simulators utilize equations representing physics of fluid flow and chemical conversion. Examples of physics-based simulators include, without limitation, reservoir simulators, pipeline flow simulators, and process simulators (e.g. separation simulators). In particular, the DMS application 24 may be utilized for defining sets of parameters in a physics-based or physical model that are unknown and that may be adjusted so that the physics-based simulator 26 may match real-time data that is actually observed in an oil or gas field. As discussed above in the discussion of FIG. 1, the real-time data may be measurement data received by the field sensors 106 through continuous monitoring. The physics-based simulator 26 is operative to create physics-based models representing the operation of physical systems such as reservoirs, wells, and pipeline networks in oil and gas fields. For instance, the physics-based models 30 may be utilized to simulate the flow of fluids in a reservoir, a well, or in a pipeline network by taking into account various characteristics such as reservoir area, number of wells, well path, well tubing radius, well tubing size, tubing length, tubing geometry, temperature gradient, and types of fluids which are received in the physics-based simulator. The physics-based simulator 26, in creating a model, may also receive estimated or uncertain input data such as reservoir reserves.

Figure 3:
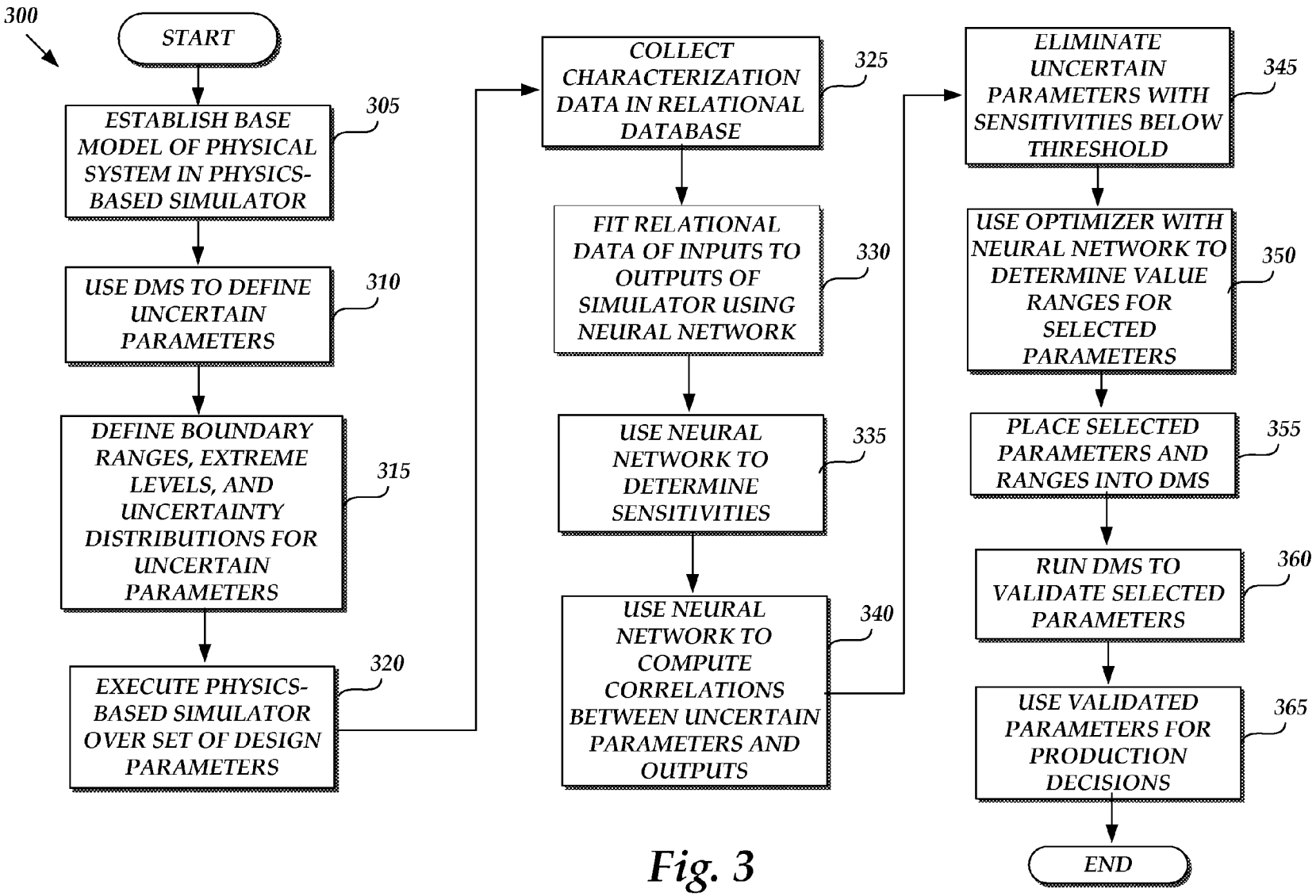
FIG. 3 is a flow diagram showing an illustrative routine for fast updating of oil and gas field production models with physical and proxy simulators, according to an illustrative embodiment of the present invention.

Referring now to FIG. 3, an illustrative routine 300 will be described illustrating a process for fast updating of oil and gas field production models using a physical and proxy simulator. When reading the discussion of the illustrative routines presented herein, it should be appreciated that the logical operations of various embodiments of the present invention are implemented (1) as a sequence of computer implemented acts or program modules running on a computing system and/or (2) as interconnected machine logic circuits or circuit modules within the computing system. The implementation is a matter of choice dependent on the performance requirements of the computing system implementing the invention. Accordingly, the logical operations illustrated in FIG. 3, and making up illustrative embodiments of the present invention described herein are referred to variously as operations, structural devices, acts or modules. It will be recognized by one skilled in the art that these operations, structural devices, acts and modules may be implemented in software, in firmware, in special purpose digital logic, and any combination thereof without deviating from the spirit and scope of the present invention as recited within the claims attached hereto.

The illustrative routine 300 begins at operation 305 where the DMS application 24 executed by the CPU 5, instructs the physics-based simulator 26 to establish a "base" model of a physical system. It should be understood that a "base" model may be a physical or physics-based representation (in software) of a reservoir, a well, a pipeline network, or a processing system (such as a separation processing system) in an oil or gas field based on characteristic data such as reservoir area, number of wells, well path, well tubing radius, well tubing size, tubing length, tubing geometry, temperature gradient, and types of fluids which are received in the physics-based simulator. The physics-based simulator 26, in creating a "base" model, may also receive estimated or uncertain input data such as reservoir reserves. It should be understood that one ore more physics-based simulators 26 may be utilized in the embodiments of the invention.

The routine 300 then continues from operation 305 to operation 310 where the DMS application 24 automatically defines uncertain parameters (i.e., unknown parameters) with respect to the base model. For instance, uncertain parameters may include, without limitation, permeability by reservoir zone, net-to-gross, well skin, fault transmissibility, vertical-to-horizontal permeability ratio, and wait on cement ("WOC").

Once the uncertain parameters are defined, the routine 300 then continues from operation 310 to operation 315 where the DMS application 24 defines boundary limits, for the uncertain parameters. In particular, the DMS application 24 may utilize an experimental design process to define boundary limits for each uncertain parameter including extreme levels (e.g., a maximum, midpoint, or minimum) of values for each uncertain parameter. The DMS application 24 may also calculate an uncertainty distribution for each uncertain parameter. Those skilled in the art will appreciate that the uncertainty distribution may be determined through the application of one or more probability density functions. In one embodiment, the experimental design process utilized by the DMS application 24 may be the well known Orthogonal Array, factorial, or Box-Behnken experimental design processes.

The routine 300 then continues from operation 315 to operation 320 where the DMS application 24 automatically executes the physics-based simulator 26 over the set of uncertain parameters as defined by the boundary limits and the uncertainty distribution determined in operation 315. It should be understood that, from this point forward, these parameters will be referred to herein as "design" parameters. In executing the set of design parameters, the physics-based simulator 26 generates a series of outputs which may be used to make a number of production predictions. For instance, the physics-based simulator 26 may generate outputs related to the flow of fluid in a reservoir including, without limitation, pressures, hydrocarbon flow rates, water flow rates, and temperatures which are based on a range of permeability values defined by the DMS application 24.

The routine 300 then continues from operation 320 to operation 325 where the DMS application 24 collects characterization data in a relational database, such as the integrated production drilling and engineering database 116. The characterization data may include value ranges associated with the design parameters as determined in operation 315 (i.e., the design parameter data) as well as the outputs from the physics-based simulator 26.

The routine 300 then continues from operation 325 to operation 330 where the DMS application 24 utilizes a regression equation to fit the design parameter data (i.e., the relational data of inputs) to the outputs of the physics-based simulator 26 using a proxy model. As used in the foregoing description and the appended claims, a proxy model is a mathematical equation utilized as a proxy for the physics-based models produced by the physics-based simulator 26. Those skilled in the art will appreciate that in the various embodiments of the invention, the proxy model may be a neural network, a polynomial expansion, a support vector machine, or an intelligent agent. An illustrative proxy model which may be utilized in one embodiment of the invention is given by the following equation:

$$z_k = g\left(\sum_j w_{kj} z_j\right)$$

It should be understood that in accordance with an embodiment of the invention, a proxy model may be utilized to simultaneously proxy multiple physics-based simulators that predict flow and chemistry over time.

The routine 300 then continues from operation 330 to operation 335 where the DMS application 24 uses the proxy model to determine sensitivities for the design parameters. As defined herein, "sensitivity" is a derivative of an output of the physics-based simulator 26 with respect to a design parameter within the proxy model. For instance, a sensitivity may be the derivative of hydrocarbon oil production with respect to permeability in a reservoir. In one embodiment, the derivative for each output with respect to each design parameter may be computed on the proxy model equation (shown above). The routine 300 then continues from operation 335 to operation 340 where the DMS application 24 uses the proxy model to compute correlations between the design parameters and the outputs of the physics-based simulator 26.

The routine 300 then continues from operation 340 to operation 345 where the DMS application 24 eliminates design parameters from the proxy model for which the sensitivities are below a threshold. In particular, in accordance with an embodiment of the invention, the DMS application 24 may eliminate a design parameter when the sensitivity or derivative for that design parameter, as determined by the proxy model, is determined to be close to a zero value. Thus, it will be appreciated that one or more of the uncertain parameters (i.e., permeability by reservoir zone, net-to-gross, well skin, fault transmissibility, vertical-to-horizontal permeability ratio, and WOC) which were discussed above in operation 310, may be eliminated as being unimportant or as having a minimal impact. It should be understood that the non-eliminated or important parameters are selected for optimization (i.e., selected parameters) as will be discussed in greater detail in operation 350.

The routine 300 then continues from operation 345 to operation 350 where the DMS application 24 uses the real-time optimization module 28 with the proxy model to determine value ranges for the selected parameters (i.e., the non-eliminated parameters) determined in operation 345. In particular, the real-time optimization module 28 generates a misfit function representing a squared difference between the outputs from the proxy model and the observed real-time data retrieved from the field sensors 106 and stored in the databases 114 and 116. Illustrative misfit functions for a well which may be utilized in the various embodiments of the invention are given by the following equations:

$$Obj = \sum_i w_i \sum_t w_t (sim(i, t) - his(i, t))^2$$

$$Obj = \sum_i w_i \left(\sum_t w_t (NormalSim(i, t) - NormalHis(i, t))^2\right)$$

where $w_i$=weight for well i, $w_t$=weight for time t, sim(i, t)=simulated or normalized value for well i at time t, and his(i, t)=historical or normalized value for well i at time t. It should be understood that the optimized value ranges determined by the real-time optimization module 28 are values for which the misfit function is small (i.e., near zero). It should be further understood that the selected parameters and optimized value ranges are representative of a proxy model which may be executed and validated in the physics-based simulator 26, as will be described in greater detail below.

The routine 300 then continues from operation 350 to operation 355 where the real-time optimization module 28 places the selected parameters (determined in operation 345) and the optimized value ranges (determined in operation 350) back into the DMS application 24 which then executes the physics-based simulator 26 to validate the selected parameters at operation 360. It should be understood that all of the operations discussed above with respect to the DMS application 24 are automated operations on the computer system 2.

The routine 300 then continues from operation 360 to operation 365 where the validated parameters may then be used to make production decisions. The routine 300 then ends.

Based on the foregoing, it should be appreciated that the various embodiments of the invention include methods, systems, and computer-readable media for fast updating of oil and gas field production models using a physical and proxy simulator. A physics-based simulator in a dynamic asset model computer system is utilized to span the range of possibilities for unknown parameters which are uncertain. A decision management application running on the computer system is used to build a proxy model that simulates a physical system (i.e., a reservoir, well, or pipeline network). It will be appreciated that the simulation performed by the proxy model is almost instantaneous, and thus faster than traditional physics-based simulators which are slow and difficult to update. As a result of the proxy model, physics-based models are updated faster and more frequently and the design process undertaken by reservoir engineers is thus facilitated.

Although the present invention has been described in connection with various illustrative embodiments, those of ordinary skill in the art will understand that many modifications can be made thereto within the scope of the claims that follow. Accordingly, it is not intended that the scope of the invention in any way be limited by the above description, but instead be determined entirely by reference to the claims that follow.

What is claimed is:

1. A method for fast updating of oil and gas field production models using a physical and proxy simulator, comprising:

establishing a base model of a physical system in at least one physics-based simulator, wherein the physical system comprises at least one of a reservoir, a well, a pipeline network, and a processing system and wherein the at least one simulator simulates a flow of fluids in the at least one of the reservoir, the well, the pipeline network, and the processing system;

defining boundary limits including extreme levels and an uncertainty distribution for each of a plurality of uncertain parameters of the physical system, wherein the plurality of uncertain parameters comprises: permeability by reservoir zone parameters, net-to-gross parameters, well skin parameters, fault transmissibility parameters, vertical-to-horizontal permeability ratio parameters, and wait on cement (WOC) parameters, and wherein the plurality of uncertain parameters comprises a set of design parameters;

fitting data comprising a series of inputs, the inputs comprising values associated with the set of design parameters, to outputs of the at least one simulator utilizing a proxy model, wherein the proxy model is a proxy for the at least one simulator, the at least one simulator comprising at least one of the following: a reservoir simulator, a pipeline network simulator, a process simulator, and a well simulator;

computing sensitivities of the set of design parameters by taking a derivative of an output of the at least one physics-based simulator with respect to each of the design parameters within the proxy model, the output being related to the flow of fluids in the reservoir and comprising at least one of the following: pressures, hydrocarbon flow rates, water flow rates and temperatures, the temperatures being based on a range of permeability values defined by a decision management application, the design parameters comprising the permeability by reservoir zone parameters, net-to-gross parameters, well skin parameters, fault transmissibility parameters, vertical-to-horizontal permeability ratio parameters, and wait on cement (WOC) parameters;

eliminating, from the set of design parameters, at least one design parameter for which the computed derivative is close to a zero value;

ranking the set of design parameters from the proxy model; and utilizing an optimizer with the proxy model to determine design parameter value ranges.

2. The method of claim 1 further comprising:

utilizing the proxy model to compute correlations between the set of design parameters and outputs of the at least one simulator; and utilizing validated selected parameters from the at least one simulator for production decisions.

3. The method of claim 2 further comprising:

defining a plurality of control parameters of the physical system for matching with the real-time observed data;

executing the at least one simulator over the set of design parameters; and collecting characterization data in a relational database, the characterization data comprising the values associated with the set of design parameters and values associated with the outputs from the at least one simulator.

4. The method of claim 3 further comprising:

selecting the design parameters for which the sensitivities are not below a threshold and their ranges from the proxy model into the decision management system; and validating the selected parameters in the at least one simulator.

5. The method of claim 1, wherein establishing the base model of the physical system in the at least one physics-based simulator comprises creating a data representation of the physical system, wherein the data representation comprises physical characteristics of the at least one of the reservoir, the well, the pipeline network, and the processing system including dimensions of the reservoir, number of wells in the reservoir, well path, well tubing size, tubing geometry, temperature gradient, types of fluids, and estimated data values of other parameters associated with the physical system.

6. The method of claim 1, wherein defining the boundary limits including the extreme levels and the uncertainty distribution for each of the plurality of uncertain parameters of the physical system comprises defining the boundary limits including the extreme levels and the uncertainty distribution for permeability, fault transmissibility, pore volume, and well skin parameters, utilizing at least one of Orthogonal Ray, factorial, and Box-Behnken experimental design processes.

7. The method of claim 1, wherein eliminating the at least one design parameter comprises eliminating the at least one design parameter when the at least one design parameter is determined to have a minimal impact on the physical system.

8. The method of claim 1, wherein utilizing the optimizer with the proxy model to determine the design parameter value ranges comprises utilizing the optimizer with at least one of the following: a neural network, a polynomial expansion, a support vector machine, and an intelligent agent.

9. A system for fast updating of oil and gas field production models using a physical and proxy simulator, comprising:

a memory for storing executable program code; and a processor, functionally coupled to the memory, the processor being responsive to computer-executable instructions contained in the program code and operative to:

establish a base model of a physical system in at least one physics-based simulator, wherein the physical system comprises at least one of a reservoir, a well, a pipeline network, and a processing system and wherein the at least one simulator simulates a flow of fluids in the at least one of the reservoir, the well, the pipeline network, and the processing system;

define boundary limits including extreme levels and an uncertainty distribution for each of a plurality of uncertain parameters of the physical system, wherein the plurality of uncertainty parameters comprises: permeability by reservoir zone parameters, net-to-gross parameters, well skin parameters, fault transmissibility parameters, vertical-to-horizontal permeability ratio parameters, and wait on cement (WOC) parameters, and wherein the plurality of uncertain parameters comprises a set of design parameters;

fit data comprising a series of inputs, the inputs comprising values associated with the set of design parameters, to outputs of the at least one simulator utilizing a proxy model, wherein the proxy model is a proxy for the at least one simulator, the at least one simulator comprising at least one of the following: a reservoir simulator, a pipeline network simulator, a process simulator, and a well simulator;

computing sensitivities of the set of design parameters by taking a derivative of an output of the at least one physics-based simulator with respect to each of the design parameters, within the proxy model, the output being related to the flow of fluids in the reservoir and comprising at least one of the following: pressures, hydrocarbon flow rates, water flow rates and temperatures, the temperatures being based on a range of permeability values defined by a decision management application, the design parameters comprising the permeability by reservoir zone parameters, net-to-gross parameters, well skin parameters, fault transmissibility parameters, vertical-to-horizontal permeability ratio parameters, and wait on cement (WOC) parameters;

eliminating, from the set of design parameters, at least one design parameter for which the computed derivative is close to a zero value;

ranking the set of design parameters from the proxy model; and utilize an optimizer with the proxy model to determine design parameter value ranges.

10. The system of claim 9, wherein the processor is further operative to:

utilize the proxy model to compute correlations between the set of design parameters and outputs of the at least one simulator; and utilize validated selected parameters from the at least one simulator for production decisions.

11. The system of claim 10, wherein the processor is further operative to:

define a plurality of control parameters of the physical system for matching with the real-time observed data;

execute the at least one simulator over the set of design parameters; and collect characterization data in a relational database, the characterization data comprising the values associated with the set of design parameters and values associated with the outputs from the at least one simulator.

12. The system of claim 11, wherein the processor is further operative to:

select the design parameters for which the sensitivities are not below a threshold and their ranges; and validate the selected parameters in the at least one simulator.

13. The system of claim 9, wherein the processor being operative to establish the base model of the physical system in the at least one physics-based simulator comprises the processor being operative to create a data representation of the physical system, wherein the data representation comprises the physical characteristics of the at least one of the reservoir, the well, the pipeline network, and the processing system including dimensions of the reservoir, number of wells in the reservoir, well path, well tubing size, tubing geometry, temperature gradient, types of fluids, and estimated data values of other parameters associated with the physical system.

14. The system of claim 9, wherein the processor being operative to define the boundary limits including the extreme levels and the uncertainty distribution for each of the plurality of uncertain parameters of the physical system comprises the processor being operative to define the boundary limits including the extreme levels and the uncertainty distribution for permeability, fault transmissibility, pore volume, and well skin parameters, utilizing at least one of Orthogonal Ray, factorial, and Box-Behnken experimental design processes.

15. The system of claim 9, wherein the processor being operative to eliminate at least one design parameter comprises the processor being operative to remove the at least one design parameter when the at least one design parameter is determined to have a minimal impact on the physical system.

16. The system of claim 9, wherein the processor being operative to utilize the optimizer with the proxy model to determine design parameter value ranges comprises the processor being operative to utilize the optimizer with at least one of the following: a neural network, a polynomial expansion, a support vector machine, and an intelligent agent.

17. A non-transitory computer-readable medium containing computer-executable instructions, which when executed on a computer perform a method for fast updating of oil and gas field production models using a physical and proxy simulator, the method comprising:

establishing a base model of a physical system in a plurality of physics-based simulators, wherein the physical system comprises at least one of a reservoir, a well, a pipeline network, and a processing system and wherein each of the plurality of simulators simulates a flow of fluids in the at least one of the reservoir, the well, the pipeline network, and the processing system;

defining boundary limits including extreme levels and an uncertainty distribution for each of a plurality of uncertain parameters of the physical system, wherein the plurality of uncertain parameters comprises: permeability by reservoir zone parameters, net-to-gross parameters, well skin parameters, fault transmissibility parameters, vertical-to-horizontal permeability ratio parameters, and wait on cement (WOC) parameters, and wherein the plurality of uncertain parameters comprises a set of design parameters;

fitting data comprising a series of inputs, the inputs comprising values associated with the set of design parameters, to outputs of each of the plurality of simulators utilizing a proxy model, wherein the proxy model is a proxy for each of the plurality of simulators, wherein each of the plurality of simulators comprises at least one of the following: a reservoir simulator, a pipeline network simulator, a process simulator, and a well simulator, and wherein the proxy model is utilized to simultaneously proxy the plurality of simulators;

computing sensitivities of the set of design parameters by taking a derivative of an output of each of the plurality of physics-based simulators within the proxy model, the output being related to the flow of fluids in the reservoir and comprising at least one of the following: pressures, hydrocarbon flow rates, water flow rates and temperatures, the temperatures being based on a range of permeability values defined by a decision management application, the design parameters comprising the permeability by reservoir zone parameters, net-to-gross parameters, well skin parameters, fault transmissibility parameters, vertical-to-horizontal permeability ratio parameters, and wait on cement (WOC) parameters;

eliminating, from the set of design parameters, at least one design parameter for which the computed derivative is below a threshold, the threshold being close to a zero value;

ranking the set of design parameters from the proxy model; and utilizing an optimizer with the proxy model to determine design parameter value ranges.

18. The computer-readable medium of claim 17 further comprising:

utilizing the proxy model to compute correlations between the set of design parameters and outputs of each of the plurality of simulators;

utilizing validated selected parameters from each of the plurality of simulators for production decisions;

executing each of the plurality of simulators over the set of design parameters; and collecting characterization data in a relational database, the characterization data comprising the values associated with the set of design parameters and values associated with the outputs from each of the plurality of simulators.

19. The computer-readable medium of claim 18 further comprising:

selecting the design parameters for which the sensitivities are not below a threshold and their ranges; and validating the selected parameters in each of the plurality of simulators.

* * * * *